United States Patent [19]

Downing

[11] 4,286,729

[45] Sep. 1, 1981

[54] TAPE DISPENSER PACKAGE WITH CORE FRICTION RING

[75] Inventor: Gerald T. Downing, Port Washington, Wis.

[73] Assignee: W. H. Brady Co., Milwaukee, Wis.

[21] Appl. No.: 94,475

[22] Filed: Nov. 15, 1979

[51] Int. Cl.[3] ..... B65D 85/672

[52] U.S. Cl. ..... 221/70; 225/51; 225/79; 225/82

[58] Field of Search ..... 221/70–74; 156/584; 225/51, 79, 82; 242/137, 137.1, 129.5, 129.8, 1; 206/409

[56] References Cited

U.S. PATENT DOCUMENTS

| | | | |
|---|---|---|---|
| 3,437,284 | 4/1969 | Philips | 242/137.1 |
| 3,743,086 | 7/1973 | Aldrich | 156/584 X |
| 3,754,643 | 8/1973 | Foster | 221/70 X |

*Primary Examiner*—Stanley H. Tollberg

*Attorney, Agent, or Firm*—Quarles & Brady

[57] ABSTRACT

A tape package for a roll of adhesive tape having a cover element joined to a base member. The cover element is formed to have a housing portion including a circular wall. A friction ring is carried on the circular wall and engages the inner core surface of the roll of tape.

3 Claims, 8 Drawing Figures

TAPE DISPENSER PACKAGE WITH CORE FRICTION RING

TECHNICAL FIELD

This invention relates to the art of packaging adhesive tape supported on a carrier web in which the tape is to be separated from the carrier web when dispensed from the package.

BACKGROUND ART

Adhesive tapes of various types are supported on a release coated or treated carrier web and wound into a roll. The roll is supported in a package that encloses the roll in order to protect it against damage or contamination during storage, shipping and use. When it is time to use the tape, the carrier web is withdrawn from the package and the adhesive tape is to be separated from the carrier web so that the user can remove the tape therefrom and apply it in the desired manner.

One form of package that has been employed for packaging rolls of adhesive tape on a carrier web is a "blister pack" that comprises a thermoformed plastic cover element having a surrounding flange that is heat sealed to a flat base member. The roll of adhesive tape is carried between the cover and base elements. In a known form of such package, the cover element is formed with a housing section that encloses the roll of tape and an exit section that is a formed channel. The carrier web is lead through the channel and then bent around an edge of the base member so that the tape will separate from the carrier web. An improved version of this general type of package is illustrated in U.S. Pat. No. 3,743,086, Aldrich, Adhesive Tape Dispenser Package; the package of this patent has an exit section of the cover element which bears against the top of the adhesive tape and thereby provides more dependable separation of the adhesive tape from the carrier web.

The adhesive tape in the above packages is generally cut into a series of individual markers arranged end-to-end on the carrier web. One benefit of using a blister pack as a storage and dispensing package is that individual markers can be applied by the user without touching and thereby contaminating the adhesive on the tape. The most common application technique to do this is to advance the tape around a sharp edge of the package to a point where about three-quarters of an individual marker has separated from the carrier web. The marker is positioned over the desired object while still attached to the carrier web. The separated portion of the marker is then pressed into position by finger pressure and the package is withdrawn to separate the remaining portion of the marker from the carrier web. In order to be able to use this application technique, a relatively high level of restraining force must be applied to the roll of tape in the package. If sufficient restraining force is not maintained during the withdrawal step, tape can be advanced during the package withdrawal action to such an extent that the subsequent marker following the one being applied will move to a position in which proper dispensing is not possible. When the subsequent marker has reached this position, it has to be manually removed from the carrier web; this raises the possibility of contaminating the adhesive by touching it and also results in a time-consuming process that is not nearly as convenient as the preferred application technique. Further, markers are often rendered unusable when this happens.

These disadvantages can appear with the known package discussed above.

It is very difficult to obtain proper restraining force or back tension when the adhesive tape is supported on a carrier web of plastic film, more so that if a paper carrier web is used. The smooth low friction surface of plastic film carrier web material significantly lowers the amount of back tension that can be obtained by channel restraining packages or friction between the end of the roll and the base member of the packages. However, plastic film is the preferred material for the carrier web in many instances.

The present invention was developed to obviate the foregoing problems, and also to provide a dispensing package that is particularly useful for adhesive tape carried on a plastic carrier web.

DISCLOSURE OF THE INVENTION

The present invention relates to a tape dispenser package of the type having a roll of adhesive tape supported on a carrier web enclosed within a package having a cover element and a base member. The cover element is formed to have a vertical wall and a ring of friction material is supported on the vertical wall to engage the core of the roll of tape. I have found this construction results in improved dispensing of the adhesive tape from the carrier web when tape is to be dispensed from the package due to the fact that the ring of friction material imposes a restraining force on the roll of tape as it rotates during dispensing. This results in back tension being applied to the carrier web to an extent which enables efficient and dependable dispensing of a single piece of adhesive tape from the carrier web under the procedure described above.

One of the main objects of this invention is to provide a tape package of the general type under consideration that includes a package element adapted to apply restraining force on the roll of tape during the dispensing action. Another is to provide a tape dispenser package having a cover element that carries a friction ring arranged to engage the inner surface of the core of a roll of tape enclosed in the package to exert restraining force as the roll of tape rotates. A more specific object is to provide the particular package constructions hereinafter set forth in the claims.

DESCRIPTION OF THE BEST MODE FOR CARRYING OUT THE INVENTION

Figure 1:
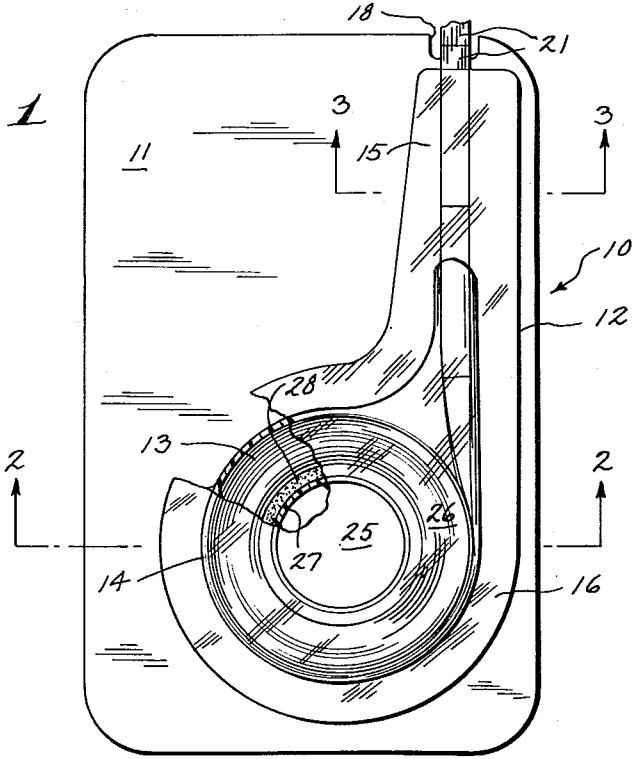
FIG. 1 is a plan view, with a portion broken away, of a tape package according to this invention.
Figure 2:
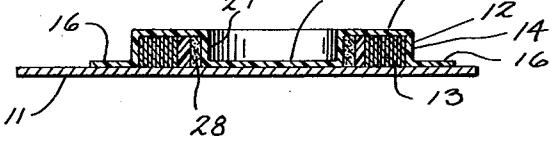
FIG. 2 is a sectional view of the package illustrated in FIG. 1 along the plane of line 2—2.

FIGS. 1 and 2 illustrate a tape package 10 according to this invention that includes a base member 11, a formed cover element 12, and a roll of adhesive tape 13.

The base member 11 may comprise a sheet of cardboard, card stock, plastic or other material of suitable rigidity. It forms the principal stiffening member of the package. In the illustrated embodiment, the base member 11 is a sheet of cardboard approximately 8 mils thick having a heat sealable coating on its upper surface.

Figure 3:
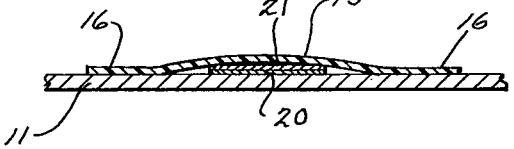
FIG. 3 is a sectional view along the plane of line 3—3 of FIG. 1 showing one form of exit channel that may be employed with the package.
Figure 4:
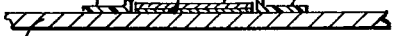
Fig. 4 PRIOR ART
FIG. 4 is another sectional view similar to FIG. 3 showing an alternate form of exit channel that can be used with the present package.

The cover element 12 is a sheet of plastic material (e.g. cellulose butyrate, styrene, polyethylene, etc.) that has been thermoformed to include a housing portion 14, an exit section 15 leading from the housing portion, and a peripheral flange 16. The flange 16 is heat sealed to the base member 11 to form the package enclosure. The roll of tape is stored in the housing portion 14 of the package and its end is led through the exit section 15 as illustrated in the drawing. The exit section 15 of the cover element may have a flat or slightly curved wall which bears against the top of the tape as illustrated in FIG. 3, which is the construction of U.S. Pat. No. 3,743,086, or it may be formed into a 3-dimensional channel as shown in FIG. 4, which is a prior art construction. The edge of the base member near the end of the exit section may be notched as at 18.

The adhesive tape 13 comprises a strip of material coated on one of its surfaces with a layer of pressure sensitive adhesive. The adhesive is releasably secured to a carrier web 20. The adhesive tape is slit into a plurality of individual markers 21 arranged end-to-end along the carrier web. The carrier web 20 is shown as a plastic film, which may be release-coated as necessary so that the adhesive layer on a marker 21 will cleanly release from the carrier web without substantial transfer of adhesive to the carrier web when it is desired to apply a marker to an object. A release coating on the carrier web may not be needed if the nature of the material selected for the carrier web and the specific adhesive on a marker are such that clean release can be obtained. The adhesive tape and the carrier web are wound into roll-form and carried on a core 22.

The roll of adhesive tape 13 is carried between the base member 11 and the cover element 12 and enclosed by the housing portion 14 of the cover element while resting upon an underlying area of the base member. The housing portion 14 of the cover element has a bottom wall 25 that is spaced from a top wall 26. A circular vertical wall 27 connects the top and bottom walls; its outer diameter is smaller than the inner diameter of the core 22. The bottom wall 25 of the housing portion may be heat sealed to the base member 11 of the package.

In accordance with this invention, a ring 28 of frictional material is carried on the vertical wall 27 and engages the inner surface of the core 22 of the roll of tape. The friction ring 28 may be made of felt, plastic foam, thick paper, etc. The specific material for the friction ring is selected to obtain suitable friction between the core of the roll and the vertical wall; also, it is to be somewhat compressable so as to provide consistent results with respect to variations in core diameter. The friction ring 28 is employed to exert restraining force on the roll of tape to generate sufficient back tension on the tape and carrier web to prevent undesired dispensing of a marker. The ring should be thick enough to provide sufficient back tension with given vertical wall and core diameters.

In prior art tape packages of the type illustrated herein, the vertical wall 27 of the housing portion has been of a smaller diameter than the inside diameter of the core on which the roll of tape is carried. The vertical wall in these prior art packages did not exert a significant restraining force on the roll of tape. If the vertical wall has a diameter such that it is sized closer to the inside diameter of the core, in order to apply friction or restraining force on the roll of tape, variations in the inside core diameter of the rolls of tape lead to wide variations in restraining force or back tension from package to package. This is an undesirable feature from the standpoint of appropriate quality control and consistent package dispensing function. When the package includes a friction ring 28 on the vertical wall 27 the friction ring has the ability to compress or yield with variations in the inside core diameter. Thus, the friction ring 28 which supports the roll of tape can be sized to achieve the proper restraining force and provide a consistent level of restraining force from package to package.

Figures 5A, 5B, 5C:
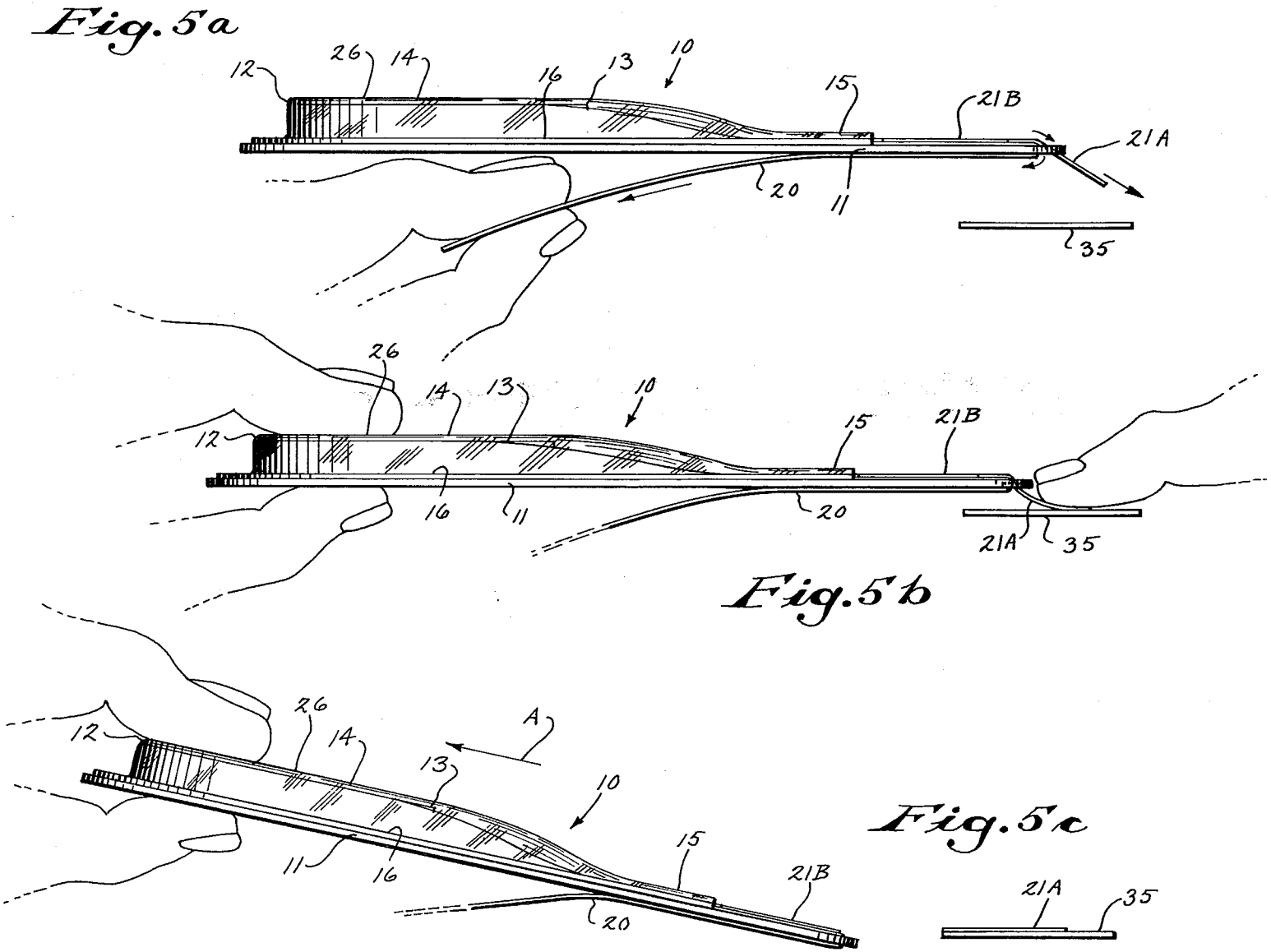
FIGS. 5A, 5B, and 5C illustrate sequential steps in the dispensing of adhesive tape markers from a package of the present invention.

The operation of the package 10 is illustrated in the sequential views of FIGS. 5A–C. When the user is ready to dispense tape from the package, the portion of the carrier web and adhesive tape extending through the exit section 15 of the package is led around the edge of the base member 11 near the exit portion. Upon crossing this edge, which forms a sharp release area, the first marker 21A is separated from the carrier web 20 as illustrated in FIG. 5A. The carrier web 20 is pulled until approximately ¾ of the marker 21A is thusly separated from the carrier web. The roll of tape in the housing portion rotates as the carrier web is pulled, and the friction ring 28 produces back tension on the tape due to the friction developed as the roll of tape rotates.

As illustrated in FIG. 5B, the user then presses the separated portion of the marker 21A onto an object 35 with finger pressure. This causes the pressure sensitive adhesive layer on the marker to adhere to the object. After the marker has been partially affixed to the object, the user withdraws the package 10 away from the object, as in the direction of the arrow A in FIG. 5C; this withdrawal action causes the remaining portion of the marker 21A to be separated from the carrier web 20 and it can then be adhered against the object 35. During this use of the package 10 to dispense a marker, the subsequent marker 21B remains in the proper position for later dispensing because the friction ring 28 exerts a restraining force against the inner surface of the core of the roll of tape to generate enough back tension against the carrier web to prevent the web from loosely unwinding from the roll and lead to improper dispensing of the marker 21B. The dispensing action illustrated in FIGS. 5A–C is one manner in which the package 10 may be employed; however, with some types of markers or adhesive tape, contamination of the adhesive layer may not be an important consideration so that a marker can be separated by hand after it has been partially dispensed as illustrated in FIG. 5A. Also, a partially dispensed marker can be removed from the carrier web mechanically such as with a pair of tweezers or other suitable appliance.

Figure 6:
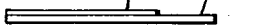
FIG. 6 illustrates the faulty dispensing process that may often occur with packages that do not employ the present invention.
Figure 6:
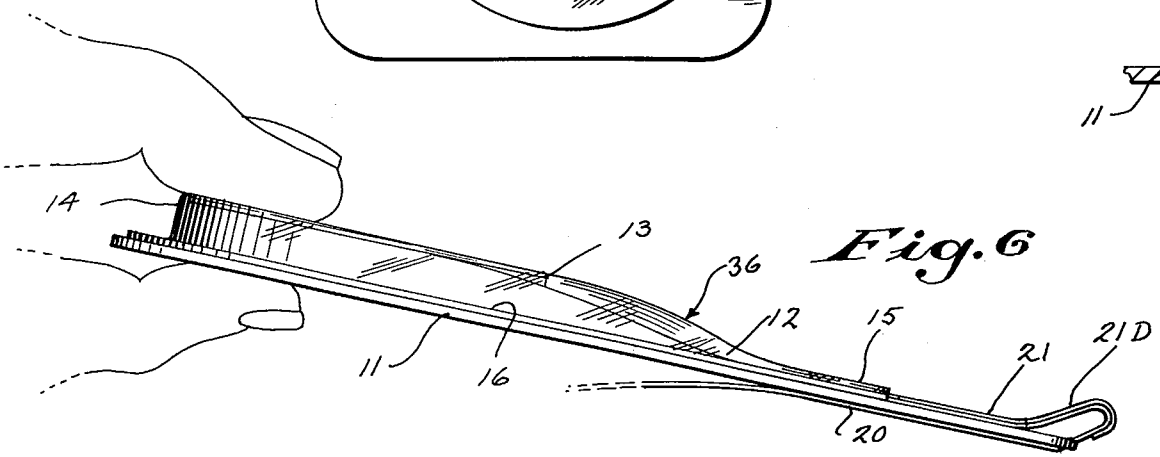

The effect of improper dispensing is illustrated in FIG. 6 in connection with a prior art package 36 that is the same as the package 10 except that it does not have the friction ring 28. After a first marker 21C has been partially applied to an object 35, and the package is withdrawn in order to remove the remaining portion of the marker from the carrier web 20, the tape and carrier web may advance during such withdrawal action to a point where the subsequent marker 21D has moved beyond the edge of the base member. When the marker 21D is in the position shown in FIG. 6, it has to be manually removed in order to be used. This leads to the possibility of contaminating the adhesive layer so as to impair its adhesion to an object, results in an undue extra amount of time, and can often lead to a marker which is unusable.

The package of this invention was used with a roll of adhesive tape comprising a strip of polyester film about 0.7 mils thick having an aluminized coating and a layer of pressure sensitive adhesive. The tape was slit into markers 21 approximately 1 inch long that were intended for use as sensing tapes for application to magnetic recording tape. The markers were supported on a carrier web consisting of a strip of polyester film about 2 mils thick. Even though the markers were very thin and lightweight, it was found that a friction ring 28 of felt in accordance with this invention developed a restraining force on the core of the roll of tape resulting in sufficient back tension on the carrier web and adhesive tape to prevent subsequent markers from being undesirably dispensed as a marker was being applied to an object. The dispensing action was effective and could be accomplished repeatedly without undesirable release of subsequent markers. Thus, the package satisfied the objects of this invention and exhibited improved performance in comparison with prior art packages.

Although this invention has been illustrated and described with respect to specific exemplary forms, it is expected that those skilled in the art will be able to devise changes to the disclosed embodiments which will enable them to practice this invention. It is to be understood, therefore, that it is intended to cover all changes and modifications of the examples of this invention herein described and other embodiments that are within the teaching of this invention.

I claim:

1. In a tape package of the type comprising (a) a base member, (b) a formed cover element having a housing portion, an exit section and a peripheral flange joined to the base member, and (c) a roll of adhesive tape carried in the housing portion with part of the tape unwound from the roll and extending through the exit section of the cover element, the improvement wherein:

(1) the housing portion of the cover element has a top wall spaced from a bottom wall, and a vertical wall connecting the top and bottom walls; and (2) a friction ring is supported on the vertical wall and engages the inner surface of the roll of tape to apply restraining force thereagainst as the roll rotates upon removal of tape from the package, the friction ring being made of compressible felt or plastic foam.

2. A tape package according to claim 1, wherein:

the adhesive tape includes a layer of pressure sensitive adhesive, a carrier web is releasably joined to the pressure sensitive adhesive, the tape and carrier web are wound into a roll supported on a core, and the adhesive tape is slit into a plurality of individual markers;

the friction ring engages the inner surface of the core on which the roll of tape and carrier web is supported; and part of the adhesive tape and the carrier web extends through the exit section of the cover element and when pulled about a nearby edge of the base member an individual marker separates from the carrier web, during which the carrier web is tensioned by the engagement of the friction ring with the inner surface of the core of the roll.

3. A tape package according to claim 2, wherein: the carrier web is a strip of plastic film.

* * * * *